US005522680A

United States Patent [19]

Hoss et al.

[11] Patent Number: 5,522,680

[45] Date of Patent: Jun. 4, 1996

[54] METHOD OF INSTALLING THE DECK OF AN OFFSHORE PLATFORM ON A SUPPORT STRUCTURE AT SEA

[75] Inventors: Jean-Louis Hoss, Sannois; Jean-Paul Labbe, Levallois Perret, both of France

[73] Assignee: ETPM, société anonyme, Nanterre, France

[21] Appl. No.: 330,182

[22] Filed: Oct. 27, 1994

[30] Foreign Application Priority Data

Oct. 29, 1993 [FR] France ..... 93 12926

[51] Int. Cl.[6] ..... E02B 17/00

[52] U.S. Cl. ..... 405/209; 405/195.1; 405/204

[58] Field of Search ..... 405/204, 209, 405/195.1, 203, 205; 114/264, 265

[56] References Cited

U.S. PATENT DOCUMENTS

| | | | |
|---|---|---|---|
| 2,907,172 | 10/1959 | Crake | 405/209 |
| 4,436,454 | 3/1984 | Ninet et al. | 405/204 |
| 4,662,788 | 5/1987 | Kypke et al. | 405/204 |
| 4,848,967 | 7/1989 | Weyler | 405/204 |
| 4,930,938 | 6/1990 | Rawstron et al. | 405/209 X |
| 5,026,226 | 6/1991 | Hollowell et al. | 405/204 |
| 5,219,451 | 6/1993 | Datta et al. | 405/204 |

FOREIGN PATENT DOCUMENTS

| | | | |
|---|---|---|---|
| 0190055 | 8/1986 | European Pat. Off. | 405/204 |
| 2516112 | 5/1983 | France . | |
| 58-181916 | 10/1983 | Japan . | |
| 8701804 | 2/1989 | Netherlands . | |

OTHER PUBLICATIONS

G. J. White et al., "Offshore Installation of an Integrated Deck Onto a Preinstalled Jacket", OCT 5 260, 18th Annual Offshore Technology Conference in Houston, TX., May 5–8, 1986.

*Primary Examiner*—Dennis L. Taylor
*Attorney, Agent, or Firm*—Gottlieb, Rackman & Reisman

[57] ABSTRACT

In this method of putting an offshore platform deck into place on a support structure by means of a ballastable barge and of a plurality of cylinder and plunger piston assemblies, it is possible to avoid shocks between the pistons and the support structure, and also between the legs of the deck and the support structure, which shocks are due to vertical movements of the deck driven by the swell during the operations of putting the deck into place. This is done by providing in each leg: a low pressure hydraulic fluid accumulator; first controllable means for establishing high flow rate bidirectional communication between the accumulator and a chamber of a cylinder of the cylinder and plunger piston assembly, above the plunger piston; second controllable means for establishing high flow rate unidirectional communication from the accumulator to the chamber; and third controllable means for establishing low flow rate communication between the chamber and a hydraulic fluid reservoir.

14 Claims, 8 Drawing Sheets

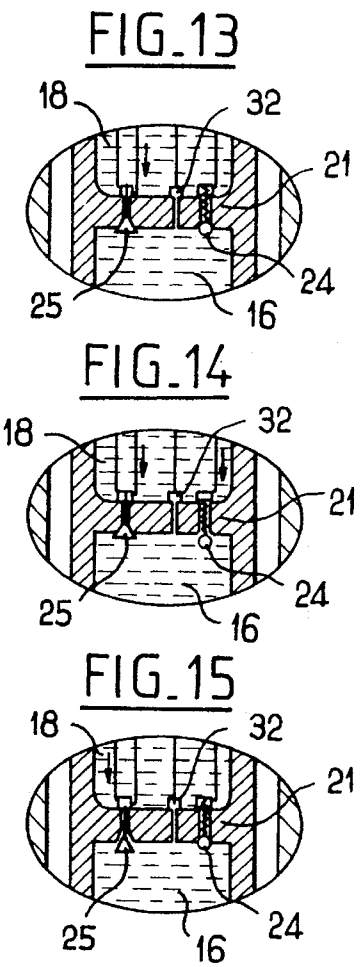
FIG_13
FIG_14
FIG_15
18
21
24
25
32
16
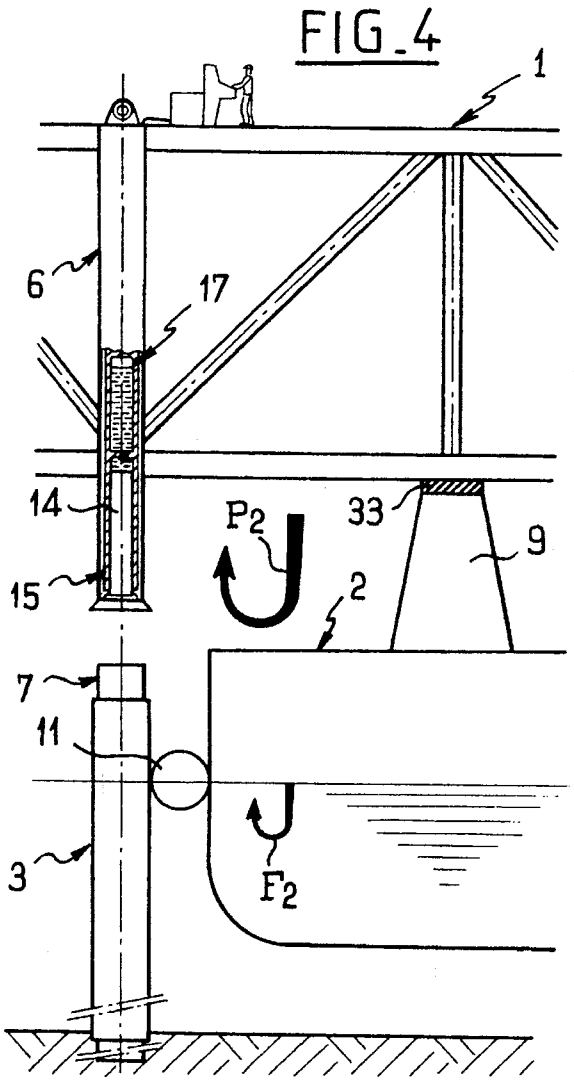
FIG_4
1
2
3
6
7
9
11
14
15
17
33
$P_2$
$F_2$
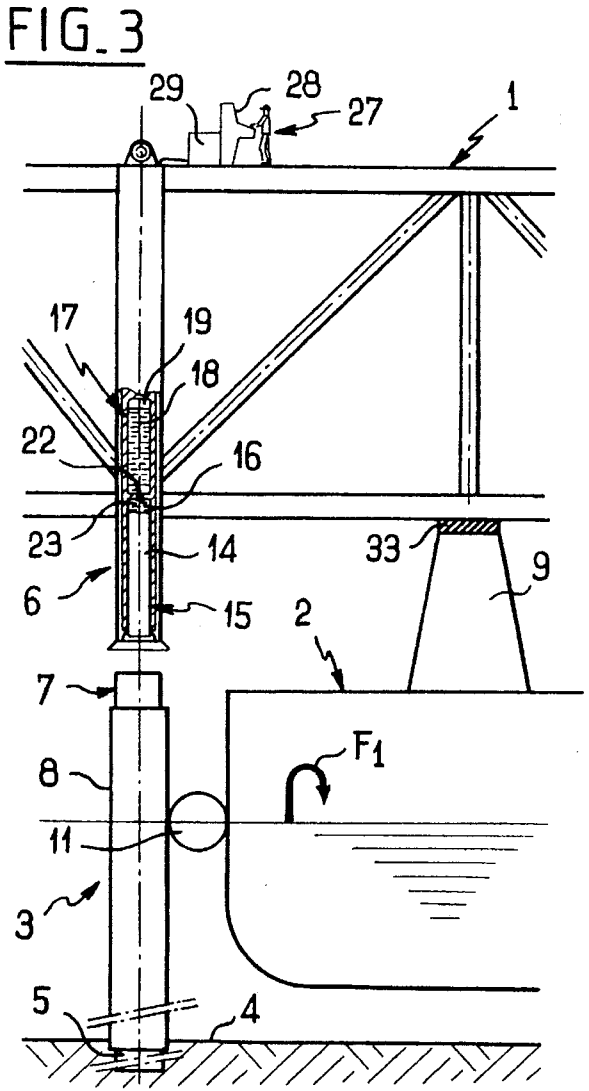
FIG_3
1
2
3
4
5
6
7
8
9
11
14
15
16
17
18
19
22
23
27
28
29
33
$F_1$ 1
6
17
15
14
7
11
3
33
9
2
P1
F1
SWELL
TROUGH 1
6
17
15
14
7
11
3
33
9
2
P2
F2
SWELL
CREST 1
27
28
6
17
15
14
7
11
3
33
9
2
P1
F1
SWELL
TROUGH

EXCEPTIONALLY HIGH SWELL CREST
F1

SWELL TROUGH
F1

SWELL CREST
F2
1
2
3
6
7
9
11
14
15
16
17
27
33

1
6
7
14
15
16
17
21
27
28
29
37
38
39
41
42
43
44
45
46
47
48
49
51
52
53
54
55
56
57
58
59
61
62
63
64
65
66
67
6a
XVII

METHOD OF INSTALLING THE DECK OF AN OFFSHORE PLATFORM ON A SUPPORT STRUCTURE AT SEA

The present invention relates to a method of installing the deck of an offshore platform on a support structure at sea, and also to a deck fitted with means enabling it to be installed on the support structure.

BACKGROUND OF THE INVENTION

In the context of the present description, the term "deck" is used for any type of superstructure for a platform installed at sea. The deck conventionally includes a plurality of vertical tubular legs made of steel or of concrete or partially of steel and partially of concrete, which legs are placed on and fixed to a support structure. The term "support structure" designates any type of infrastructure, sometimes called a "jacket" in this technical field, and designed to support the deck of the offshore platform. In operation, the support structure may be entirely or partially immersed, and it may or may not stand on the seabed. The support structure usually includes a number of vertical or substantially vertical tubular members and/or piles corresponding to the number of legs of the deck. The said tubular members of the support structure, also called "legs", are referred to as "vertical members" in the present description for simplification purposes, given that these members may be genuinely vertical or may slope somewhat relative to the vertical or they may be vertical in part and sloping relative to the vertical in part. The vertical members and/or piles may be made of metal or of concrete or partially of metal and partially of concrete. In addition, in the context of the present description, the term "barge" is used to designate any ballastable floating vehicle capable of transporting the deck of an offshore platform.

The deck and the support structure of an offshore platform are usually prefabricated separately on land or in a dry dock or in a graving-dock, and they are then convoyed or towed separately to a site at sea where they are subsequently assembled together. The assembly site may be the utilization site of the platform, or any other site chosen for sufficient depth of water and sea conditions that are relatively calm.

Several techniques have already been proposed for installing the deck of an offshore platform on a support structure at sea. For example, one known technique is described in the article entitled "Offshore Installation of an Integrated Deck Onto a Preinstalled Jacket", by G. J. White et al., OTC 5 260, Offshore Technology Conference, 18th Annual Conference at Houston, Tex., May 5–8, 1986. In that known technique each leg of the deck contains a hydraulic cylinder and plunger piston assembly, and each vertical member or pile of the support structure includes at its top end a receiver portion suitable for receiving the bottom end of the plunger piston associated the corresponding leg of the deck. That known method comprises the following operations:

a) bringing a barge between the vertical members or piles of the support structure, with the deck supported on the barge by a plurality of retractable supports;

b) positioning and holding the barge in such a manner that the legs of the deck are and remain substantially in alignment with the corresponding vertical members or piles of the support structure;

c) lowering the plunger pistons until their bottom ends come into abutment against the receiver portions of the corresponding members or piles of the support structure;

d) ballasting the barge to lower it and transfer the load of the deck to the support structure;

e) subsequently retracting the supports situated between the deck and the barge so that the deck is supported solely by the support structure;

f) making rigid connections between the legs of the deck and the vertical members or piles of the support structure; and g) evacuating the barge from between said vertical members or piles.

Operations f) and g) may be performed in the above-specified order, in the reverse order, or simultaneously.

In the open sea, that known technique presently suffers from limits that are due in particular to the relative movements between the deck and the support structure which are caused by the swell and which can give rise to unacceptable stresses or impacts in the assembly constituted by the deck, the barge, and the support structure. In particular, during the operation of ballasting the barge, while said barge is still supporting at least a part of the weight of the deck, and in spite of the presence of shock absorbing devices, the above-mentioned relative movements can cause impacts to occur both between the plunger pistons and the corresponding receiver portions of the support structure and also between the bottom ends of the deck legs and the top ends of the vertical members or piles of the support structure. In that known technique, impacts between the bottom ends of the deck legs and the top ends of the vertical members or piles of the support structure are practically inevitable as the ballasting operation approaches its end and the bottom ends of the deck legs come close to the top ends of the vertical members or piles of the support structure. Given the very large masses involved (the weight of the deck may be several thousands or several tens of thousands of tons), the above-mentioned impacts give rise to battering or deformation of the elements that strike one another. The battering or the deformation can subsequently make it very difficult or even impossible to connect the deck legs to the support structure.

Furthermore, in that known technique, the receiver portion provided at the top end of each vertical member or pile of the support structure comprises a guide tube whose top end is flared to receive and center the plunger piston associated with the corresponding deck leg. Once the plunger piston has penetrated into the guide tube, the horizontal components of the movement of the deck (surge) induced by the swell generate horizontal forces. These make it necessary to provide shock absorber devices operating in compression between the guide tube and the outer cylindrical wall of the vertical member or pile of the support structure. In spite of the presence of such shock absorbers, the support structure and, by reaction, the structure of the deck, can be subjected to unacceptable stresses that may harm the integrity of these structures.

OBJECTS AND SUMMARY OF THE INVENTION

An object of the present invention is thus to provide a method and means making it possible to avoid the impacts which occur when the above-described known technique is used.

Another object of the present invention is to provide means making it possible to reduce the stresses that result from interactions between the vertical members or piles of the support structure and the deck legs, which stresses are generated by the horizontal movement components of the deck due to the swell.

To this end, the method of the invention consists, for operation c), in allowing the plunger pistons to descend under their own weight, while establishing large flow rate bidirectional communication between a low pressure hydraulic fluid accumulator and a chamber in the top portion of each hydraulic cylinder above the plunger pistons so as to bring each of the plunger pistons into contact with the receiver portion of the corresponding vertical member or pile of the support structure; then, during an observation stage, allowing the barge, the deck, and the hydraulic cylinders to oscillate vertically with the swell relative to the plunger pistons bearing against said corresponding receiver portions, while leaving said bidirectional communication open; then establishing high flow rate communication that is unidirectional only from said low pressure accumulator to said chamber in each hydraulic cylinder so as to prevent any downwards movement of the deck and of the hydraulic cylinders, but without preventing any upwards movement thereof and without preventing the chamber filling with hydraulic fluid should there pass beneath the barge a wave having its crest at a level that is higher than the level that the water occupied at the moment when unidirectional communication was established; subsequently performing operations d) and e); subsequently establishing low flow rate communication from said chamber of each hydraulic cylinder to a hydraulic fluid reservoir so as to enable the deck and its legs to be lowered until the legs come into contact with and are supported by the top ends of the vertical members or of the piles of the support structure; and subsequently performing operation f).

Because of the method of the present invention, as soon as the plunger pistons come into contact with the corresponding receiver portions of the vertical members or piles of the support structure, no impact can then arise between those elements, given that the deck is free to oscillate vertically without entraining the plunger pistons with it in its vertical movement, because of the bidirectional communication established between the low pressure accumulators and the chambers of the hydraulic cylinders. It may be observed that at this moment, the vertical distance between the bottom portions of the deck legs and the top portions of the vertical members or piles of the support structure is still large and no shock can occur between them at this moment. Thereafter, throughout the operation of ballasting the barge, the deck and its legs are prevented from any downwards movement and are held at a distance from the top portions of the vertical members or piles of the support structure. The deck is free only to rise to a higher level under the action of larger waves, but without entraining the plunger pistons with it because of said unidirectional communication between the low pressure accumulators and said chambers of the hydraulic cylinders. Here again, no impact can take place either between the plunger pistons and the corresponding receiver portions of the support structure, or between the bottom ends of the deck legs and the top ends of the vertical members or piles of the support structure. Thereafter, at the end of the barge ballasting operation, once the weight of the deck has been transferred to the support structure and the barge has been removed, the deck is no longer subjected to the action of the swell. Consequently, when the low flow rate communication is established between the chamber of each hydraulic cylinder and the hydraulic fluid reservoir, the deck can be lowered slowly and without jolting until its legs come into contact with the top portions of the vertical members or piles of the support structure, and this can be done without the swell being capable of producing uncontrolled impacts between the deck legs and the support structure.

The present invention also provides an offshore platform deck including a plurality of vertical tubular legs designed to be vertically assembled on vertical members or piles of a previously-immersed support structure, each leg of the deck containing a hydraulic cylinder and plunger piston assembly in which the cylinder is fixed to the leg and the plunger piston is capable of being displaced vertically relative to the cylinder and to the leg for the purpose of being brought into abutment against a corresponding receiver portion provided at the top end of each vertical member or pile of the support structure, and a control and monitoring unit for controlling the operation of the hydraulic cylinder and plunger piston assemblies contained in the legs of the deck, wherein, inside each hydraulic cylinder, above its plunger piston, a chamber is formed which is filled with hydraulic fluid, and wherein each leg also contains a low pressure hydraulic accumulator, first means capable of being controlled to establish high flow rate bidirectional communication between the low pressure accumulator and said chamber of the hydraulic cylinder, second means capable of being controlled to establish high flow rate unidirectional communication from the low pressure accumulator to said chamber, and third means capable of being controlled to establish low flow rate communication between said chamber and a hydraulic fluid reservoir, said first, second, and third means being controlled in sequence by said control and monitoring unit.

The present invention also provides a support structure for an offshore platform, the support structure comprising a plurality of vertical members or piles designed to be assembled to and to support respective legs of a platform deck, each vertical member or pile including a receiver portion at its top end designed to receive and serve as an abutment for a plunger piston mounted to move vertically in a corresponding leg of the platform deck, wherein said receiver portion is in the form of a cavity which is upwardly open and whose inside diameter is substantially greater than the outside diameter of the plunger piston, and wherein the bottom of the cavity is provided with a stratified shock absorber assembly composed of a bottom layer of pad forming elastomer material, a metal reinforcing plate, and an antifriction layer made of a substance that is selected to present a low coefficient of friction with the substance of the plunger piston, thereby enabling limited horizontal sliding movements between the plunger piston and the bottom of the cavity without coming into contact with a side wall thereof.

BRIEF DESCRIPTION OF THE DRAWINGS

Other characteristics and advantages of the present invention appear more clearly from the following description which is given with reference to the accompanying drawings, in which:

FIGS. 3 to 12 are diagrammatic views on a larger scale showing the relative positions of a deck leg and of a vertical member or pile of the support structure during successive stages of the method of the present invention.

FIGS. 13 to 15 are diagrammatic section views on an even larger scale showing a detail of one of the hydraulic cylinder and plunger piston assemblies used in the method of the invention, these figures showing, in particular, a controlled non-return valve and a controlled on-off valve, which valves are shown in their various states during implementation the method of the invention.

MORE DETAILED DESCRIPTION

Figure 2:
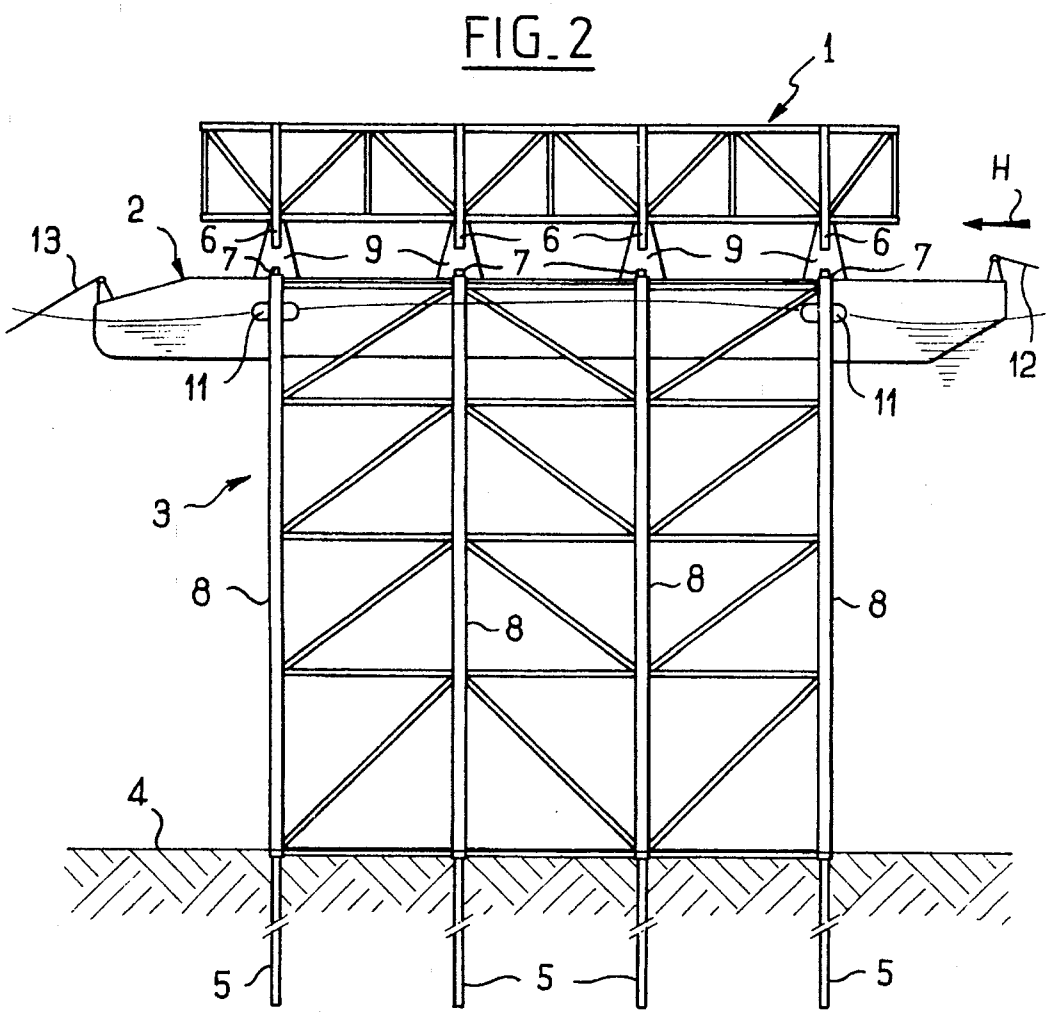
FIGS. 1 and 2 are front and side elevation views showing a deck loaded on a barge that is anchored between the piles of a support structure (jacket).
Figure 1:
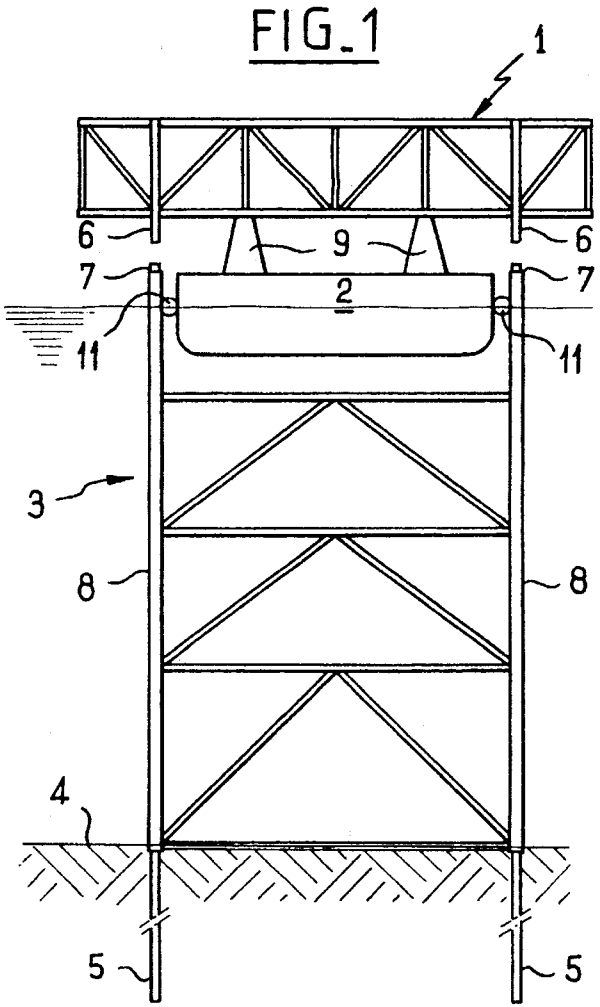

In FIGS. 1 and 2, there can be seen the deck 1 of an offshore platform loaded on a barge 2 which has been put into position inside a support structure 3 (jacket) for the purpose of installing the deck 1 thereon. In FIGS. 1 and 2, the support structure 3 is fixed on the seabed 4 by piles 5, e.g. eight piles in the example shown here. However, the method of the invention can also be implemented with a floating support structure that is appropriately anchored to the seabed 4, e.g. by a plurality of mooring lines.

The deck 1 has a plurality of legs 6, e.g. eight legs designed to be placed on receiver portions 7 of the support structure 3. The receiver portions 7 which are described in greater detail below may be formed, as shown here, at the top ends of the piles 5 clear of the water, or they may be formed at the top ends of vertical tubular members 8 of the support structure 3 through which the piles 5 have been engaged in order to be driven into the seabed 4. Nevertheless, it should be observed that the receiver portions 7 could be formed on any other portion of the support structure 3 deigned to withstand the static and dynamic vertical forces brought into play during the operations of installing the deck 1 and while the platform is in operation.

As shown in FIGS. 1 and 2, the deck 1 rests on the barge 2 via a plurality of retractable supports 9, eight supports. These supports 9 are shown diagrammatically since they are elements well known in this technical field, such as sand boxes, hydraulic jacks, or retractable mechanical devices.

The barge 2 is oriented to face the dominant swell by previously orienting the support structure 3 appropriately, and it is held in position relative to the support structure by means that are likewise well known in this technical field. Sway movements of the barge are limited, e.g. by four flexible fenders 11. Surge movements are limited, e.g. by fore and aft mooring lines 12 and 13.

As shown in FIG. 3, for example, each leg 6 of the deck 1 is hollow and is constituted, for example, by a steel tube of circular section. Within each leg 6 there is to be found an assembly of elements comprising:

a) a plunger piston 14 slidably mounted in a hydraulic cylinder 15 itself fixed to the leg 6 in a manner that is described in detail below. The chamber 16 formed in the hydraulic cylinder 15 above the plunger piston 14 is filled with a hydraulic fluid such as oil;

b) a low pressure accumulator 17 situated above the assembly comprising the cylinder and the plunger piston 14, 15. The outside envelope of the accumulator 17 may, for example, be integrally formed with the hydraulic cylinder 14 as shown in FIG. 3 (see also FIG. 16). The accumulator 17 contains oil 18 and a gas or a gas mixture 19 at a low pressure of the order of a few bars. This gas, which may be nitrogen, for example, tends to expel the oil 18 towards the chamber 16, and consequently to push the plunger piston 14 downwards. The quantity of oil 18 contained in the accumulator 17 is greater than the volume necessary to enable the plunger piston 14 to perform its maximum stroke; and c) a plurality of closable orifices which are provided in a wall 21 (see FIGS. 13 to 15) separating the chamber 16 of the hydraulic cylinder 15 and the inside cavity of the accumulator 17. In FIGS. 3 to 12, these closable orifices are represented diagrammatically and overall by a single orifice 22 and a single needle valve 23.

In fact, said closable orifices comprise a plurality of controlled non-return valves, e.g. three or four valves 24 and at least one controlled on-off valve 25 (to simplify the drawing, FIGS. 13 to 15 show only one controlled non-return valve 24 and only one controlled on-off valve 25). When the non-return valves 24 receive a control signal to open, they establish high flow rate bidirectional communication between the inside cavity of the accumulator 17 and the chamber 16 of the hydraulic cylinder 15 (FIG. 14). In the absence of an open control signal, the non-return valves 24 establish high flow rate unidirectional communication from the inside cavity of the accumulator 17 towards said chamber 16. When opened by a control signal, the controlled on-off valve 25 establishes low flow rate communication between the chamber 16 and a reservoir of hydraulic fluid. Although the reservoir of hydraulic fluid is shown in FIGS. 13 and 15 as being constituted by the inside cavity of the pressure accumulator 17, this hydraulic fluid reservoir is preferably constituted by a reservoir separate from said pressure accumulator and disposed, for example, on the deck 1 of the platform as indicated diagrammatically at 26 in FIG. 26.

As described below, the controlled non-return valves 24 and the controlled on-off valve 25 enable the plunger piston 14 to operate in three different modes under the control of an operator 27 acting on a control desk 28, or under the control of a programmable control unit replacing said operator. It is preferable for the controlled non-return valves 24 and the controlled on-off valve 25 to be opened under hydraulic control, however they could be controlled electromagnetically. Very little power is required (of the order of a few tens of kW) to switch from one mode of operation to another and to control the entire operation of placing the deck 1 on the support structure 3. The hydraulic power required for this purpose may come from a hydraulic power unit 29 installed on the deck 1. A single control desk 28 and a single hydraulic power unit 29 can suffice for all of the hydraulic cylinder and plunger piston assemblies 14, 15 installed in the legs 6 of the deck 1.

Inside each leg 6, an auxiliary actuator 31 (FIG. 23) may be provided above the chamber 16. The auxiliary actuator 31 which is not essential for implementing the method of the invention has several functions. A first function of the auxiliary actuator 31 is to enable the plunger piston 14 to be held in its high position while the deck 1 is being transported (this function could equally well be performed by a fusible mechanical connection, e.g. using fuse bolts, or else a retractable abutment). A second function of the auxiliary actuator 31 is to enable the plunger piston 14 to be braked in the course of its descent (this function could equally well be performed by a mechanical friction braking system). A third function of the auxiliary actuator 31 is to enable the plunger piston 14 to be raised if necessary (for example when reversing the process of putting the deck into place, or to enable the plunger piston 14 to be returned into the hydraulic cylinder 15 after the deck has been put in place).

The three operating modes of the plunger piston 14 are as follows. In the following description, terms such as "descend" and "rise" specifying downwards and upwards movement of the plunger piston 14 designate movement relative to the cylinder 15.

In the first mode (mode 1), the plunger piston 14 is free to descend inside the cylinder 15 under its own weight, the weight of the oil in the chamber 16, and the low pressure of the oil in the accumulator 17. The plunger piston 14 is also free to rise when subjected to an external vertically upward force greater than the sum of the above-mentioned forces. This operating mode is obtained by controlling the non-return valves 24 so as to hold them open (high flow rate bidirectional communication between the accumulator 17 and the chamber 16) while holding the controlled on-off valves 25 closed. This mode of operation corresponds to FIGS. 5, 6, 7, and 14.

In the second mode (mode 2), the plunger piston 14 is free to descend inside the cylinder 15, but it cannot rise. Also in this mode, if the plunger piston 14 is fixed, e.g. because it is bearing against the receiver portion 7 of the corresponding pile 5 of the support structure 3, then the cylinder 15 and the leg 6 to which it is fixed are free to rise relative to the plunger piston 14, but they cannot descend again. This mode of operation is obtained by leaving the non-return valves 24 to operate as non-return valves proper, enabling oil to enter the chamber 16 from the accumulator 17, but preventing oil from leaving said chamber 16 (high flow rate unidirectional communication from the pressure accumulator 17 towards the chamber 16), and while simultaneously keeping the controlled on-off valve 25 closed. This mode of operation corresponds to FIGS. 8 to 11, and 13.

In the third mode (mode 3), the plunger piston is assumed to be fixed, bearing against the receiver portion 7 of the corresponding pile 5 of the support structure 3. The cylinder 15 and the leg 6 to which it is fixed can descend in slow and controlled manner sliding on the plunger piston 14. This descent movement is made possible by opening the controlled on-off valve 25. In this mode of operation, the non-return valves 24 are kept closed by the pressure of the oil that exists in the chamber 16, which pressure is greater than the pressure in the accumulator 17. This mode of operation corresponds to FIGS. 12 and 15.

In addition to these three modes of operation, the plunger piston 14 must be capable of being held in the high retracted position during transport of the deck 1 and at the beginning of the process for putting it into place. As mentioned above, this may be achieved, for example, by means of the auxiliary actuator 31.

FIGS. 13 to 15 also show a pressure sensor 32 mounted in the wall 21 and serving to measure and monitor the pressure inside the chamber 16 of the hydraulic cylinder 15. The output signal from the pressure sensor 32 is conveyed via an appropriate line to a control and monitoring unit contained in the desk 26.

With reference to FIGS. 3 to 12 there follows a description of the method of the invention for putting into place or installing the deck 1 on the support structure 3.

First stage or observation stage I (FIGS. 3 and 4)

During this stage, the barge 2 is held inside the structure 3 in position for installing the deck. All of the plunger pistons 14 are held in their high positions inside their cylinders 15. The barge 2 is then ballasted to reduce the height through which the plunger pistons 14 are to drop. During this stage, the barge 2 is subject to the action of the swell as represented diagrammatically by arrows F1 and F2 in FIGS. 3 and 4. The movements of the barge 2 due to the swell are limited by the shock absorber devices 11 and the mooring lines 12 and 13, as mentioned above.

When it has been observed that the swell has a preferred direction at the installation site (indicated by the arrow H in FIG. 2 and referred to as the "dominant" swell), then it is advantageous for the barge 2 to be oriented in this direction and consequently for the support structure 3 to have previously been installed in the same direction. Under such conditions, rolling movement is reduced to a minimum, thereby very considerably reducing the vertical movements of the barge 2 and of the deck 1. These movements are previously estimated in known manner by calculation. The amplitudes and the periods of these movements are now measured in known manner on site prior to moving on to the following stage of the process for putting the deck into place. Normal operating conditions with respect to these movements are of the order of a decimeter for horizontal movements and of the order of a meter or more for vertical movements.

At this point, the process of putting the barge into place is still reversible, and the barge 2 together with the deck 1 can be withdrawn at any moment from their position inside the support structure 3.

Figure 7:
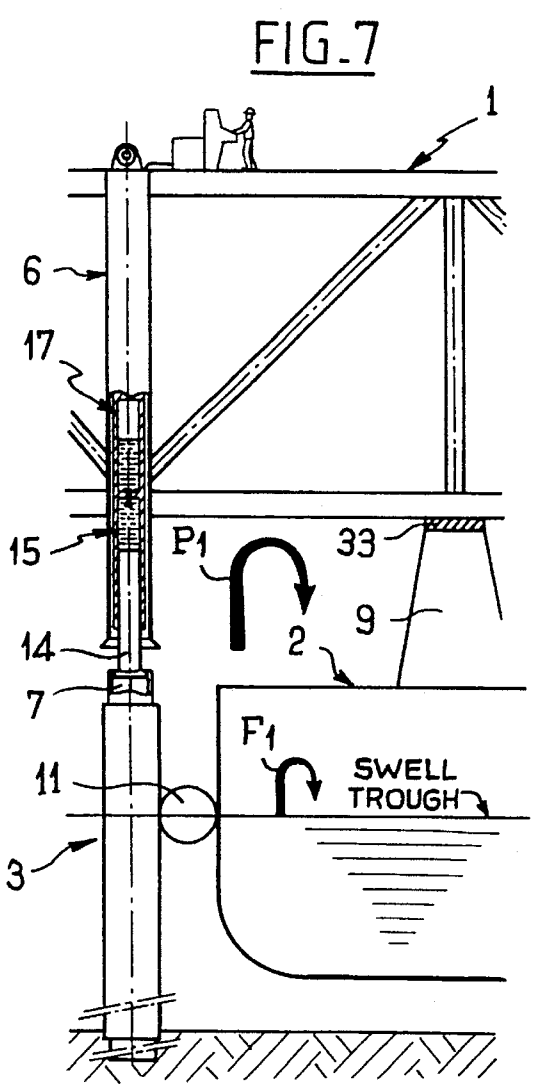
Figure 6:
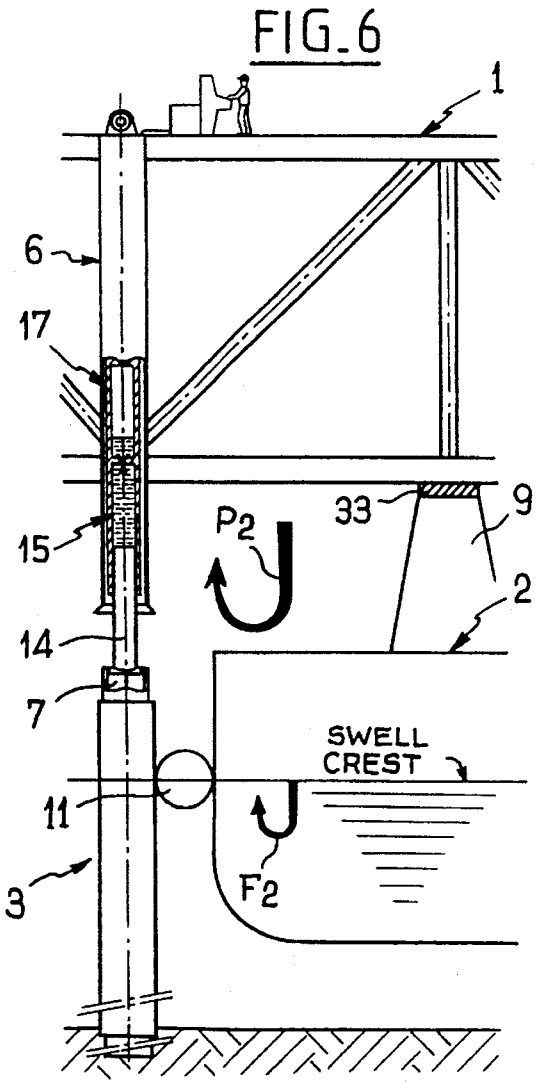
Figure 5:
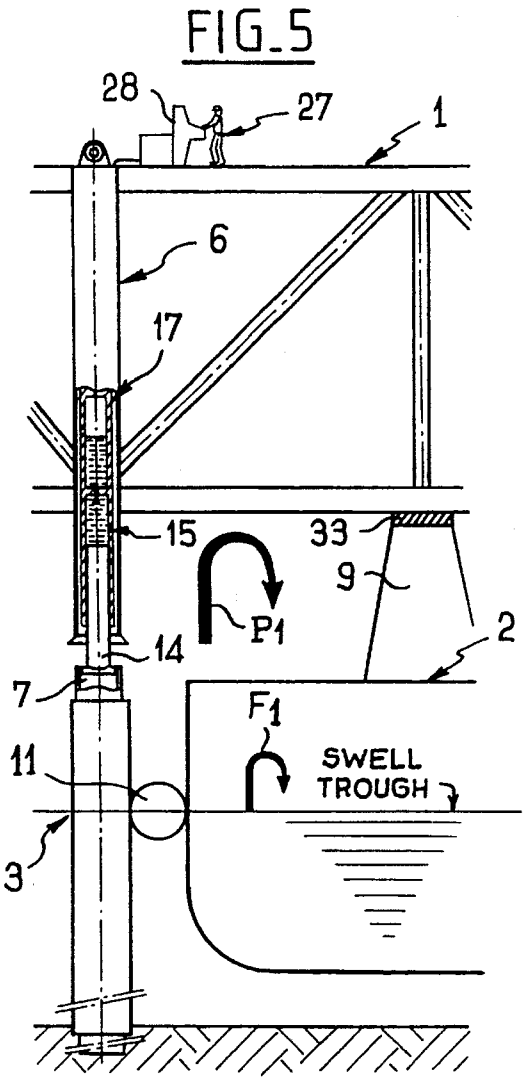

Second stage or descent stage of the plunger pistons 14 and observation stage II (FIGS. 5 to 7)

Swell measurement buoys (not shown) placed in known manner at a certain distance from the support structure 3 inform the operator 27 about the nature of the swell wave trains reaching the support structure 3, and in particular about the height and the period of the waves.

Measurement devices (gyro-accelerometers, not shown) placed on each assembly 14, 15, 17 provide the operator 27 in real time with full information relating to the movements of the deck 1. Proximity detectors may also be used for the same purpose.

The operator 27 then initiates the descent of the eight plunger pistons 14 by causing them to operate in mode 1 and leaving the piston rods free to move out from the auxiliary actuators 31.

It should be observed that a high flow rate of oil is necessary to enable the plunger pistons 14 to reach the receiver portions 7 of the structure 3 without lifting off them. It is necessary for the plunger pistons 14 to be capable of descending in half the period of the swell, i.e. in about 3 to 6 seconds. This high flow rate (which is of the order of several hundreds of liters per second) is provided by the non-return valves 24, with the number and/or flow section thereof being selected accordingly.

During this stage, the barge 2 and the deck 1 are subjected to the effects of the swell. In FIGS. 5 to 7, the movements of the deck 1 as a function of the swell are represented diagrammatically by arrows P1 and P2.

There is no privileged moment for starting the descent of the plunger pistons 14. However, given that the descent of the plunger pistons 14 takes only a few seconds, it is nevertheless preferable to start said descent only when ready to move on to the following stage. By observing the swell and the movements of the deck, the operator 27 has all the information necessary for passing on to the third stage.

During the second stage, after the descent of the plunger pistons 14, the movements of the barge 2 are practically the same as during the first stage.

Once extended and in contact with the receiver portions 7 of the support structure 3, the plunger pistons 14 remain in this position. The cylinders 15 fixed to the legs 6 of the deck 1 perform vertical up and down movement by sliding on the plunger pistons 14.

The horizontal movements of the barge 2 give rise to horizontal movements at the bottom ends of the plunger pistons 14 which slide on the receiver portions 7 of the support structure 3. As described below, this sliding can be facilitated by covering the receiver portions 7 of the support structure 3 and/or the bottom ends of the plunger pistons 14 with appropriate materials having a low coefficient of friction. These materials may, for example, be stainless steel sliding on "Teflon" (registered trademark). The outside diameter of the bottom ends of the plunger pistons 14 and the inside diameter of the receiver portions 7 of the support structure 3 must be compatible with the horizontal sliding movements to ensure that the above-specified elements 7 and 14 never come into abutment in the horizontal direction.

The pitching of the barge 2 causes the deck 1 to slope in variable manner, and consequently causes the legs 6 of the deck and the pistons 14 therein to slope likewise. This slope of the pistons 14 could give rise to their bottom ends being badly engaged on the receiver portions 7 of the support structure 3. This problem can be solved by providing a swivel-mounted foot at the bottom end of each plunger piston 14, as described below.

At this point, it is still possible to reverse the process of putting the deck into place, the plunger pistons 14 can be moved back up by means of the auxiliary actuators 31, and the barge 2 can therefore still be evacuated if that should be made necessary by bad sea conditions.

Figures 8, 9, 10:
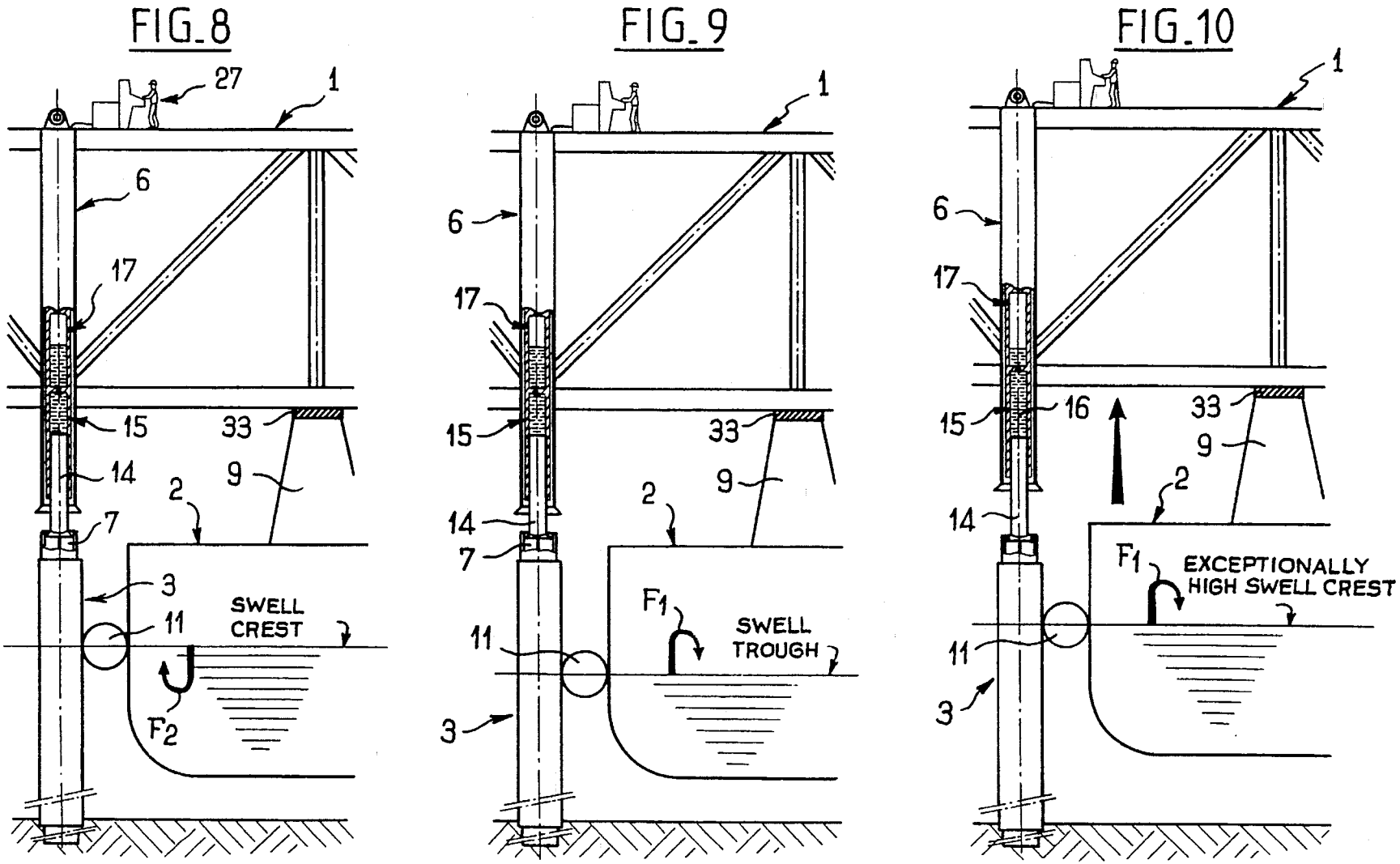

Third stage or stage during which the hydraulic cylinders 15 are locked (FIGS. 8 to 10)

This stage consists in preventing the deck 1 from moving relative to the support structure 3 by acting simultaneously on all of the hydraulic cylinder and plunger piston assemblies 15, 14. This is done by switching the operating mode of the plunger pistons 14 from mode 1 to mode 2 by deactivating the control signals applied to the non-return valves 24 so that they operate as non-return valves proper.

The operator 27 triggers this operation at the most appropriate moment, i.e. the moment that will give rise firstly to the smallest amount of inertial forces in the entire system constituted by the deck 1, the barge 2, and the support structure 3, and secondly when the deck 1 is as high as possible so that the non-return valves 24 are called on to operate as little as possible. Nevertheless, it is important to observe that although the two above conditions enable the hydraulic system to operate under ideal conditions, it is not absolutely essential for them to be satisfied completely. In other words, the system can be designed so that it is possible to lock the cylinder and piston assemblies 15, 14 at any moment or at least within a range of acceptable limit conditions.

To trigger locking of the cylinder and piston assemblies 15, 14 at the appropriate moment, the operator 27 must take account of the reaction time of the non-return valves 24 and of their control circuits. Locking of the cylinder and piston assemblies 15, 14 may also be controlled directly by a programmable controller unit which may be provided for handling all of the data in the system.

FIG. 8 shows the cylinder and piston assembly 15, 14 locked while riding on the crest of the swell. When a trough of the swell passes beneath the barge 2 (FIG. 9) the barge stops moving since it is held up beneath the deck 1 which has become fixed relative to the support structure 3. A fraction of the weight of the deck 1 is then supported by the support structure 3.

FIG. 10 shows that if a swell crest that is higher than the preceding crests passes beneath the barge 2, then the barge raises the deck 1 but the deck cannot move back down again thereafter. During this upward movement of the deck 1, the non-return valves 24 open and the chamber 16 fills with an additional quantity of oil coming from the accumulator 17. During this time, the plunger pistons 14 remain pressed against the receiver portions 7 of the support structure 3. Once the crest of the highest wave has passed beneath the barge 2 and the barge begins to move back down again, the non-return valves 24 close automatically and the additional quantity of oil that has penetrated into the chamber 16 remains trapped therein. Consequently the cylinder 15 cannot move back down again and the assembly comprising the barge 2 and the deck 1 remains in a raised position when the following swell trough comes beneath the barge 2.

After a few exceptionally high swell crests have gone past, each plunger piston 14 will thus be in a position of maximum extension that is substantially identical for all of the pistons 14. Consequently, the deck 1 will itself be in a maximum height position that is practically horizontal. The deck 1 therefore ceases to move under the effect of the swell apart from movements due to the elasticity of the assembly comprising the deck 1, the barge 2, and the support structure 3.

Once the cylinder and piston assemblies 15, 14 have been locked, it can be seen that the barge 2 continues to be subjected to swell forces. Furthermore, when locking takes place, inertial forces due to the masses in motion are added to the swell forces. The vertical component of all these forces can be absorbed at several locations, selectively or in combination:

a) by blocks 33 of elastomer material or by any other equivalent device well known in this technical field, disposed between the supports 9 and the deck 1;

b) by elements of elastomer material or any other equivalent device disposed between the bottom portion of each plunger piston 14 and the corresponding receiver portion 7 of the support structure 3, as described below; and c) by at least one high pressure accumulator communicating with the chamber 16 of each cylinder and plunger piston assembly 15, 14.

It will be seen in the description below of an embodiment how these absorbers may be disposed. Depending on requirements, one or more of the above-mentioned absorbers are used.

In addition, the flexibility of the deck 1 and of the barge 2 also contributes to reducing the above-mentioned vertical forces. For a deck weighing 10,000 tons with swell having a maximum height of 1.8 meters (m) and a period of about 8 seconds, the vertical forces in each cylinder and piston assembly 15, 14 may reach values lying in the range 1,000 tons to 2,000 tons during this third stage. The pressure of the oil in the chamber 16 can reach values of the order of 400 bars.

Under the effect of horizontal forces applied by the swell to the barge 2, the junctions between the supports 9 and the deck 1 and also between the plunger pistons 14 and the receiver portions 7 are stressed in turn. This stress is dynamic and therefore capable of being reduced by suitably disposed absorbers made of elastomer material. Thus, the junctions between the plunger pistons 14 and the receiver portions 7 of the support structure 3 are preferably made in such a manner that their mutually contacting surfaces have a low coefficient of friction.

Here again, when the plunger piston 14 is subjected to a large vertical force, it is desirable for it to be possible for sliding to take place between the plunger piston 14 and the corresponding receiver surface 7 of the support structure. Sliding will take place only when the friction forces between the two mutually contacting surfaces are overcome. Under such conditions, the maximum horizontal force applied to the bottom portions of the plunger pistons 14 is limited by the coefficient of friction, thereby guaranteeing proper operation of the cylinder and piston assemblies 15, 14 at all times. The horizontal forces in the legs 6 of the deck 1 are limited for the same reason.

At this point the process of putting the deck into place is still reversible. It suffices merely to put the non-return valves 24 in the open position and to raise the plunger pistons 14 by means of the auxiliary actuators 31.

Figure 11:
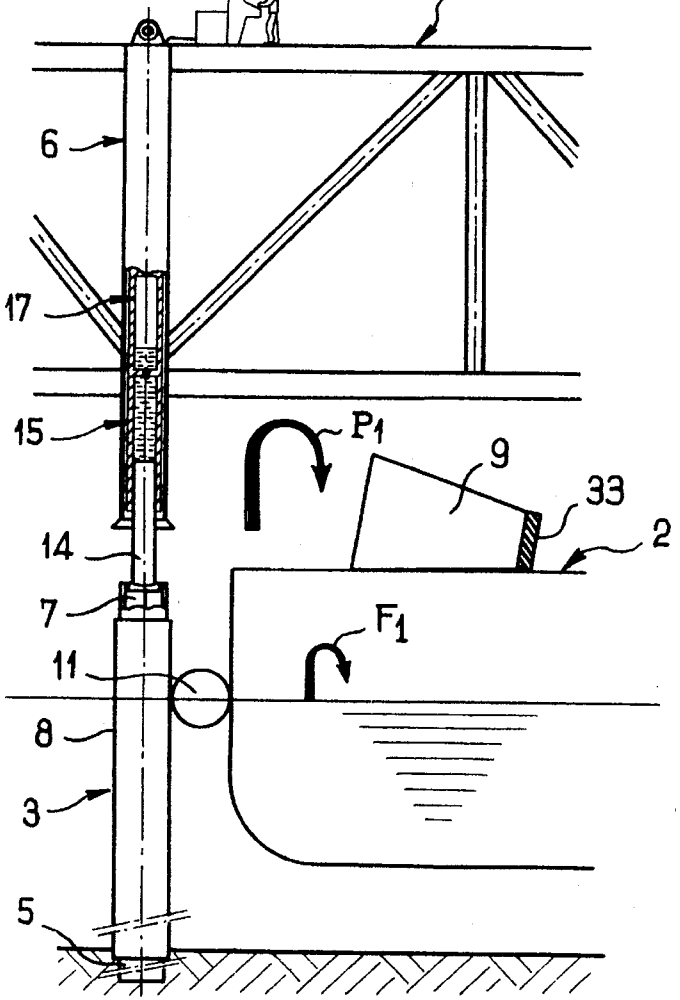

Fourth stage during which the barge 2 is ballasted, the supports 9 are withdrawn, and the barge 2 is removed (FIG. 11)

During this stage, all of the weight of the deck 1 is to be transferred from the barge 2 to the support structure 3, after which the barge 2 is removed. This operation is performed by ballasting the barge 2 as is known in this technical field.

Ballasting can be monitored by measuring the forces in the cylinder and piston assemblies 15, 14, either by means of strain gauges, or by measuring the pressure of the oil in the chambers 16, e.g. by means of the pressure sensors 32.

The barge becomes heavier while continuing to press up against the underside of the deck 1 until the moment when the reaction between the supports 9 and the deck 1 becomes small enough, i.e. when it reaches a few percent of the weight of the deck 1, with the remainder of the weight already being transferred to the support structure 3. Ballasting can be performed in a few hours. In this configuration, when the barge 2 is supporting only a small fraction of the weight of the deck 1, the supports 9 are withdrawn simultaneously and quickly, i.e. more quickly than the heaving movement of the barge 2 under the effect of the swell so as to avoid any shock between the supports 9 and the deck 1 (FIG. 11). This is made possible by the supports 9 being constituted by sand boxes or by hydraulic jacks, or by supports that include a mechanism enabling them to be retracted, all of which elements are well known in this technical field.

This moment constitutes the point of no return in the process of putting the deck into place. When the supports 9 are withdrawn, the barge 2 is lightened by that fraction of the weight of the deck 1 that it was still carrying. Its draft therefore decreases in proportion to this reduction in weight, and the barge 2 rides correspondingly higher in the water. Since it is again free to move, the barge 2 starts moving under the effect of the swell. The vertical distance through which the supports 9 are retracted is selected in known manner so that at no time while in this configuration can the barge come again into contact with the deck 1 under the effect of the swell and thereby provoke undesirable impacts. The barge 2 can thus subsequently be evacuated without difficulty from between the vertical members 8 of the support structure 3.

Figure 12:
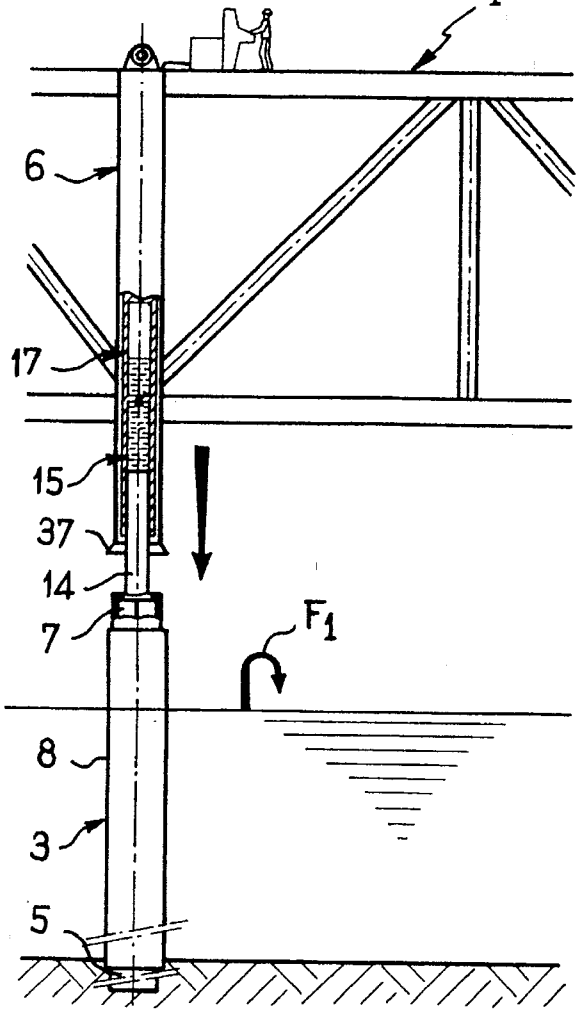

Fifth stage or stage during which the deck 1 is lowered onto the support structure 3 and put into place thereon (FIG. 12)

Figure 26:
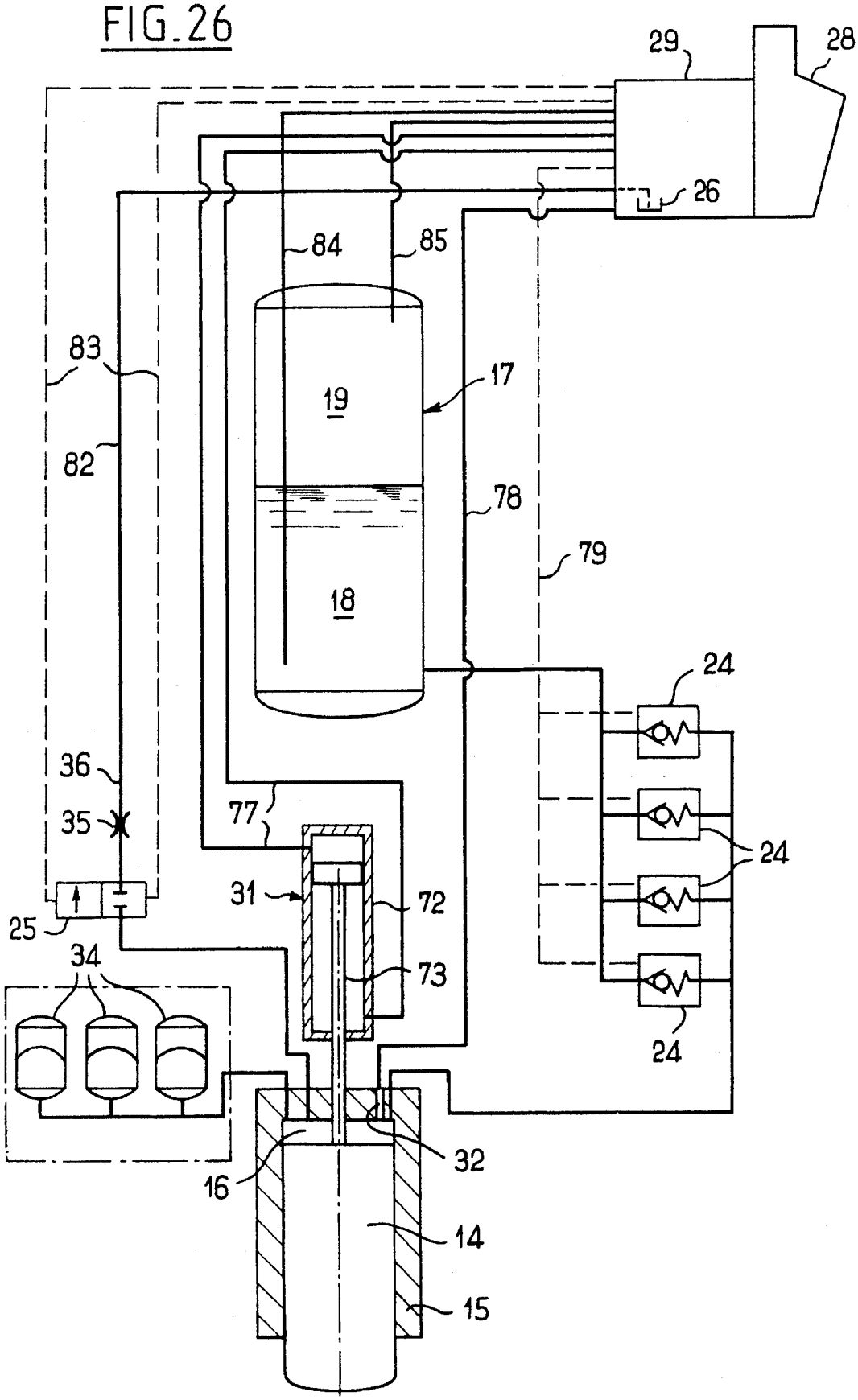
FIG. 26 is a diagram of the hydraulic circuits of the hydraulic assembly housed in a deck leg.

The deck 1 now needs to be lowered until its legs 6 come into contact with the corresponding receiver portions 7 of the support structure 3. This is achieved by switching the operating mode of the plunger pistons 14 from mode 2 to mode 3 by opening the controlled on-off valves 25. These valves, in combination with flow rate limiters 35 (FIG. 26) enable the deck 1 to be lowered in controlled manner. As mentioned above, the on-off valves 25 put the chambers 16 of the cylinders 15 into communication with a hydraulic fluid reservoir 26, e.g. via respective pipes 36 (FIG. 26). The pipes 36 associated with some of the hydraulic cylinders 15 may be connected to one another to provide isostatic support (three-point support) of the deck 1 on the support structure 3 and thereby avoid overloads in the hydraulic cylinders 15 while the deck 1 is being lowered. Lowering takes place very slowly, and consequently without shock.

Figures 16, 17, 18, 19, 20, 21, 22:
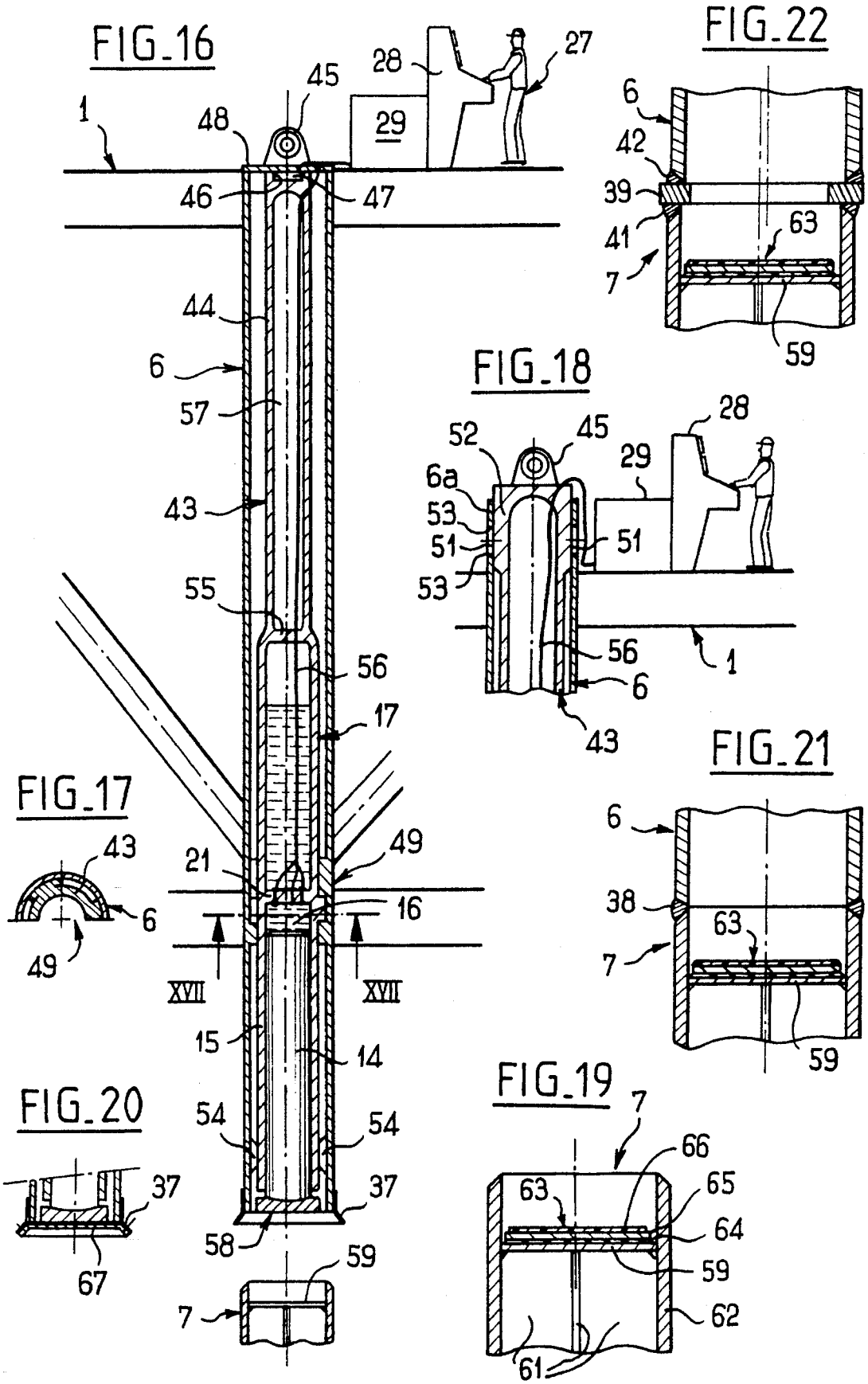
FIG. 16 is a vertical section view of one of the legs of the deck of the offshore platform.
FIG. 17 is a half-view in section on line XVII—XVII of FIG. 16, this figure showing one way of fixing a hydraulic cylinder to the deck leg.
FIG. 18 is a vertical section view through the top portion of a deck leg, this figure showing another possible way of fixing the hydraulic cylinder to said leg.
FIG. 19 is a vertical section view on a larger scale showing a receiver portion at the top end of a pile of the support structure.
FIG. 20 is a section view of the bottom portion of the deck leg, showing a detail.
FIG. 21 is a vertical section view showing one way of connecting the bottom portion of a deck leg to the top portion of a pile of the support structure.
FIG. 22 is a vertical section view showing another way of connecting the bottom portion of a deck leg to the top portion of a pile of the support structure.

At the end of the descent of the deck 1, a centering cone 37 fixed to the bottom end of each leg 6 serves to enable the legs 6 of the deck to be automatically centered relative to the receiver portions 7 of the support structure 3. After the centering cones 37 have been removed, the bottom portions of the deck legs 6 can be rigidly fixed to the corresponding receiver portions 7 of the support structure 3, e.g. by means of respective welded seams 38, as shown in FIG. 21.

Nevertheless, it is possible to omit centering cones 37 if some other assembly technique is used between the deck legs 6 and the corresponding receiver portions 7 of the support structure 3. For example, a thick steel washer 39 may be disposed between the contact surfaces of each deck leg 6 and the corresponding receiver portion 7 of the support structure, as shown in FIG. 22. This makes it possible to accommodate a degree of eccentricity between the elements 6 and 7. The washer 39 may be fixed to the receiver portion 7 by a welded seam 41 and the leg 6 can be fixed to the washer 39 by another welded seam 42.

Once the descent of the deck 1 has terminated and the legs 6 have been fixed to the corresponding receiver portions 7 of the support structure 3, the assemblies constituted by the elements 14, 15, and 17 can be removed from the legs 6 of the deck 1, as explained below.

It should also be observed, that once the platform has reached the end of its lifetime, it needs to be dismantled. If its deck was installed by means of the apparatus of the present invention, then the deck can also be removed from the support structure 3 using the same apparatus. The various stages of the process for removing the deck are the same as those used for installing the deck, except that they take place in reverse order and in the opposite direction.

Various embodiments of the assembly comprising the piston 14, the hydraulic cylinder 15, and the accumulator 17 are now described.

FIG. 16 is a vertical section through a first embodiment of said assembly. In FIG. 16, there can be seen a cylindrical body 43 whose length is approximately equal to that of the leg 6 of the deck 1 and which comprises three portions: a bottom portion which forms the hydraulic cylinder 15 and which contains the plunger piston 14, a middle portion which forms the envelope of the accumulator 17, and a top portion 44 which serves mainly for handling the body 43. A hoisting lug 45 is fixed to the top of the body 43. This lug 45 enables the body 43 to be attached to the hook of a hoist, such as a crane, to enable the body 43 to be put into place inside the leg 6 prior to the operations of putting the deck 1 into place, and also to enable the body 43 to be removed after deck installation has been terminated. The body 43 and the functional elements it contains can thus be reused in a new operation of putting a deck into place similar to the operation described above.

A cavity 46 may be provided at the top of the body 43. This cavity 46 is the ideal location for receiving a gyro-accelerometer 47 for giving the operator 27 all of the information required about the movements of the deck 1. The gyro-accelerometer 47 is directly connected to the control and monitoring unit contained in the control desk 28.

A protective plate 48 is also fitted to the top of the body 43 and it may bear against the top of the leg 6, so as to take up a fraction of the weight of the body 43 and of the elements it contains.

The body 43 is fixed in detachable manner to the leg 6 by a connection 49 (also shown in horizontal section in FIG. 17) of the type that is locked by twisting through one-third of a turn about the vertical axis of the body 43. Naturally, it would also be possible to achieve locking by twisting through some other angle of rotation. This type of connection makes it possible to transmit large vertical forces upwards and downwards.

FIG. 18 shows another possible way of fixing the body 43 to the leg 6 of the deck. With this method of fixing, the leg 6 is extended upwards by a portion **6*a* which projects above the deck 1 and in which a plurality of openings 51 are formed. At its top, the body 43 includes an enlarged cylindrical portion 52 which is engaged by sliding inside the extension 6*a* of the leg 6. The enlarged cylindrical portion 52 of the body 43 is fixed to the extension 6*a* of the leg 6 by weld fillets 53 formed in each of the openings 51. The total section of the weld fillets must naturally be sufficient to transmit the vertical forces generated during installation of the deck 1. Once the operation of putting the deck into place has come to an end, the body 43 can be removed together with the functional elements it contains by cutting off the extension 6*a* of the leg 6 beneath the openings 51 flush with the deck 1 and by using a hoist attached to the hoist lug 45**.

With reference again to FIG. 16, there can be seen centering wedges 54 (there must be at least three of them) which are secured to the leg 6 and which ensure that the bottom portion of the body 43 (the hydraulic cylinder 15) is held in a centered position inside the leg 6. The centering wedges 54 could naturally be replaced by a centering ring.

The body 43 includes two internal horizontal partitions, namely above-mentioned partition 21 and a partition 55. The partitions 21 and 55 constitute respectively the bottom and the top of the inside cavity of the low pressure accumulator 17. The partition 21 defines the top of the chamber 16 of the hydraulic cylinder 15 which contains the plunger piston 14, together with a certain volume of oil above the piston. The partition 21 must be of sufficient thickness to be able to withstand the high oil pressures that arise inside the chamber 16 during the process of putting the deck 1 in place, as mentioned above. As also mentioned above, the controlled non-return valves 24, the controlled on-off valve 25, and the pressure sensor 32 are all mounted in the partition 21 (FIGS. 13 to 15).

Ducts for feeding oil under pressure to control the non-return valves 24 and the on-off valve 25 and the conductors that transmit the output signal from the pressure sensor 32 are disposed in a sheath or duct 56 which passes through the inside cavity of the accumulator 17, through the partition 55, along the chamber 57 situated above the partition 55 inside the top portion 44 of the body 43, and passes through the top of the body 43 to terminate at the hydraulic power unit 29 and at the control desk 28.

In the bottom portion of FIG. 16, there can be seen the centering cone 37 which is fixed to the bottom end of the leg 6 and which serves to center the leg relative to the corresponding receiver portion 7 of the support structure 3 when they dock at the end of the operation of lowering the deck 1 (fifth above-described stage).

At the bottom of FIG. 16, there can also be seen a foot or bottom piece 58 whose bottom face is plane and whose top face is in the form of a concave or convex spherical cap that engages the complementary convex or concave shape at the bottom end of the plunger piston 14. Swivel-mounted in this way, the foot 58 enables the plunger piston 14 to remain properly in contact with the receiver portion 7 of the support structure during the operations of putting the deck 1 into place even when the leg 6 slopes relative to the vertical because of movements due to the swell. The concave and convex spherical surfaces that are in mutual contact can slide one over the other, but they are prevented from coming apart as will be seen from an embodiment described below.

As shown in FIGS. 16 and 19, the receiver portion 7 at the top end of each vertical member 8 or pile 5 of the support structure 3 is in the form of an upwardly open cavity whose inside diameter is substantially greater than the outside diameter of the plunger piston 14. The bottom of the cavity is constituted by a support plate 59 which forms an axial abutment for the plunger piston 14. The support plate 59 is stiffened underneath by gussets 61 in a cross-configuration. The support plate 59 and the gussets 61 are welded together and to the tube 62 constituting the vertical tubular member 8 or the pile 5 of the support structure.

Preferably, the top face of the support plate 59 forming the bottom of the cavity in the receiver portion 7 is provided with a laminated shock absorber assembly 63 made up of a bottom layer 64 of elastomer material that forms a pad capable of working in compression and in shear, a metal reinforcing plate 65, and an antifriction layer 66 of a material that is chosen for its low coefficient of friction with the material of the plunger piston 14 or of its foot 58. For example, the layer 66 may be made of "Teflon". The inside diameter of the tube 62 and the substance constituting the layer 66 are selected while taking account of the horizontal forces that are generated during the process of putting the deck 1 into place and in such a manner as to enable limited horizontal sliding movements between the plunger piston 14 and the support plate 59, while nevertheless ensuring that the plunger piston 14 cannot come into contact with the wall of the tube 62.

FIG. 20 shows a device designed to protect the hydraulic cylinder and plunger piston assembly 15, 14 while the deck 1 is being transported at sea. This device is constituted by a cover 67 fixed to the centering cone 37 by bolts. The cover 67 may also serve as a safety abutment for the plunger piston 14 during transport. It is removed once the barge 2 has reached the installation site for the deck 1.

Figure 23:
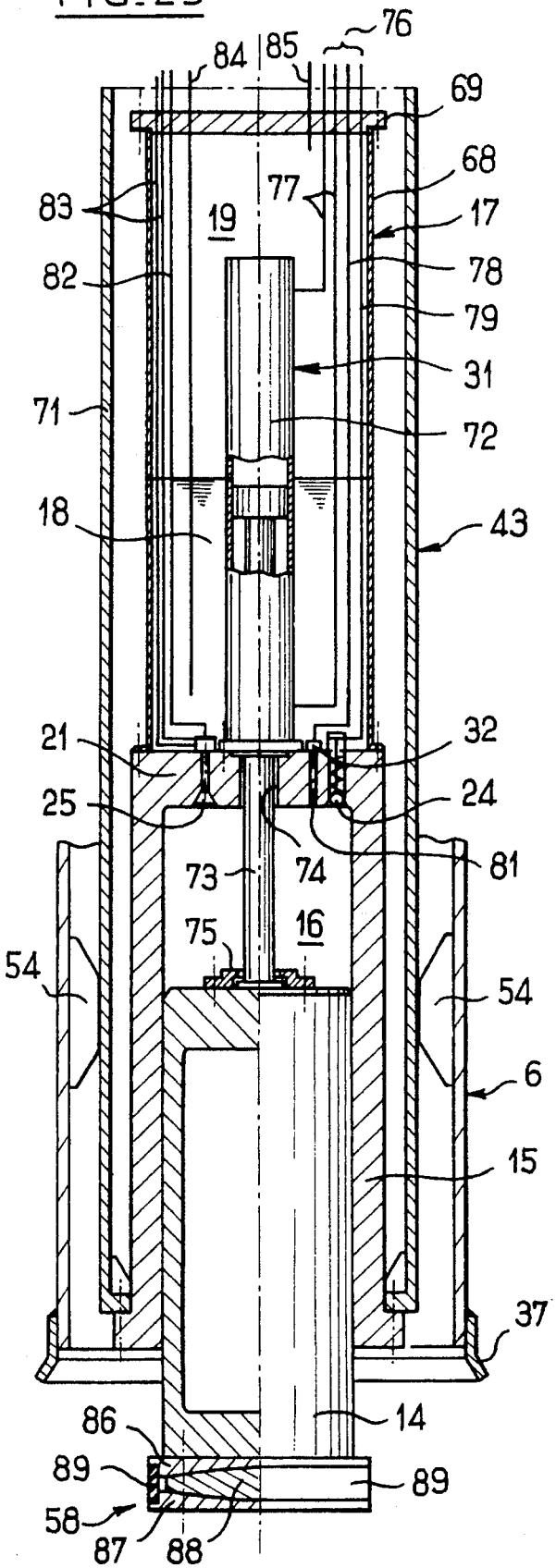
FIG. 23 is a vertical section view showing one embodiment of an assembly comprising a hydraulic cylinder, a plunger piston, a low pressure accumulator, and an auxiliary actuator, which assembly is housed inside a deck leg.

FIG. 23 shows another embodiment of the hydraulic cylinder and low pressure accumulator assembly. In FIG. 23, elements which are identical or which perform the same function as elements described above are designated by the same reference numerals and are not described again in detail. The description therefore relates to the main differences compared with the embodiment described above. In the embodiment of FIG. 23, the body 43 is not made as a single piece, but is built up from three distinct portions that are connected together by bolting. These three portions are as follows:

a) the hydraulic cylinder 15;

b) a tube 68 which forms the cylindrical wall of the low pressure accumulator 17; and c) a tube 71 whose bottom end is fixed to the bottom end of the hydraulic cylinder 15 by bolts.

The bottom end of the tube 68 is fixed to the top end of the hydraulic cylinder 15 by bolts, and the top end of the tube 68 is closed by a cover 69. The tube 71 is designed to transmit to the leg 6 the forces exerted on the hydraulic cylinder 15 during the operations of putting the deck 1 into place. The length of the tube 71 is substantially equal to the length of the leg 6. It is held in a centered position inside the leg 6 by wedges 54. The connection between the tube 71 and the leg 6 may be of the same type as the connection 49 shown in FIGS. 16 and 17, or of the same type as the connection shown in FIG. 18.

In FIG. 23, there can also be seen the auxiliary actuator 31 which enables the plunger piston 14 to be manipulated. The cylinder 72 of the auxiliary actuator 31 is disposed inside the low pressure accumulator 17, coaxially with the tube 68, and it is fixed in sealed manner to the wall 21 forming the top end of the hydraulic cylinder 15. The piston rod 73 of the auxiliary actuator 31 passes through a hole 74 formed in the center of the wall 21 and it penetrates into the chamber 16 of the hydraulic cylinder 15 where it is fixed to the top end of the plunger piston 14 by a clamping device 75 providing axial connection between the elements 14 and 73, while allowing the other degrees of freedom necessary for proper operation of the plunger piston 14 and of the auxiliary actuator 31.

The clamping device 75 may alternatively be situated at the bottom end of the plunger piston 14 if use is being made of a plunger piston that is hollow and without a top end wall.

The auxiliary actuator 31 is shown here as a double-acting actuator, but that is not absolutely necessary since the essential functions of the auxiliary actuator 31 are, as already mentioned above, successively to enable the plunger piston 14 to be held in its high position, to brake the plunger piston 14 during its descent, and optionally to raise the plunger piston 14 should that be necessary. The auxiliary actuator 31 could therefore be constituted by a single-acting actuator.

The auxiliary actuator 31 may be controlled by the hydraulic power unit 29 via an appropriate hydraulic fluid distributor valve and/or via controllable rated valves (not shown) enabling the auxiliary actuator 31 to perform the above-mentioned functions and serving, in particular, to enable the rod of the piston 73 to follow the movement of the plunger piston 14 as it is driven downwards by its own weight and by the pressure of the oil coming from the low pressure accumulator 17, or upwards by reaction from the support structure.

In FIG. 23, the lines 76 represent a set of oil feed pipes 77 for the auxiliary actuator 31, the conductors 78 that convey the output signal from the pressure sensor 32 to the control desk 28 and the oil feed pipe(s) 79 for controlling the non-return valves 24. It will be observed that the pressure sensor 32 could be located remotely from the partition 21, e.g. on the cover 69 or in the control desk 28. In that case, the conductors 78 are replaced by an oil pressure measurement pipe which is connected to the orifice 81 of the partition 21. The pipe 82 is connected to the controlled on-off valve(s) 25 and serves to evacuate oil under pressure from the chamber 16 towards the reservoir 26 provided in the hydraulic power unit 29. The two pipes 83 are oil feed pipes enabling the controlled on-off valve(s) 25 to be controlled. The pipe 84 serves to return the oil to the low pressure accumulator 17.

The pipe 85 serves to charge the low pressure accumulator 17 with a gas or a mixture of gases such as air or nitrogen.

With the apparatus shown in FIG. 23, it is possible for the hydraulic power unit 29 which provides the hydraulic power required for operation of the elements described above to be disposed immediately above the cover 69. However, under such circumstances, it would be necessary to provide a separate hydraulic power unit for each leg 6 of the deck.

FIG. 23 also shows the swivel-mounted foot 58 enabling the plunger piston 14 to bear in articulated manner against the support plate 59 (FIGS. 16 and 19) of the corresponding receiver portion 7 of the support structure 3. As shown, the foot 58 comprises a top plate 86 which is fixed, e.g. by means of bolts, to the bottom end of the plunger piston 14 and which possesses a concave bottom face in the form of a spherical cap; a bottom plate 87 whose bottom face is plane and whose top face is concave, being in the form of a spherical cap; and an intermediate piece 88 in the form of a biconvex lens whose top and bottom faces match the concave faces of the plates 86 and 87. The plate 87 is tied to the plate 86 by a system of bolts that allow relative sliding to take place between the plate 86 and the intermediate piece 88, and between the intermediate piece and the plate 87. A sleeve 89 of elastomer material is fixed around the periphery of the plates 86 and 87. The sleeve 89 provides protection against dirt or moisture penetrating between the plates 86 and 87. To facilitate sliding of the plates 86 and 87 and of the intermediate piece 88 relative to one another, the concave faces of the plates 86 and 87 or the convex faces of the intermediate piece 88 may be coated with a layer of anti-friction material, e.g. "Teflon". When provision is made for stainless steel to slide on "Teflon" between the plunger piston 14 and the support plate 59, the bottom plate 87 may be made of stainless steel if the shock absorber device 63 (FIG. 19) is provided on the support plate 59. However, if the support plate 59 does not include any shock absorber device such as the device 63, then the bottom face of the plate 87 may also be provided with a layer of "Teflon".

Figure 24:
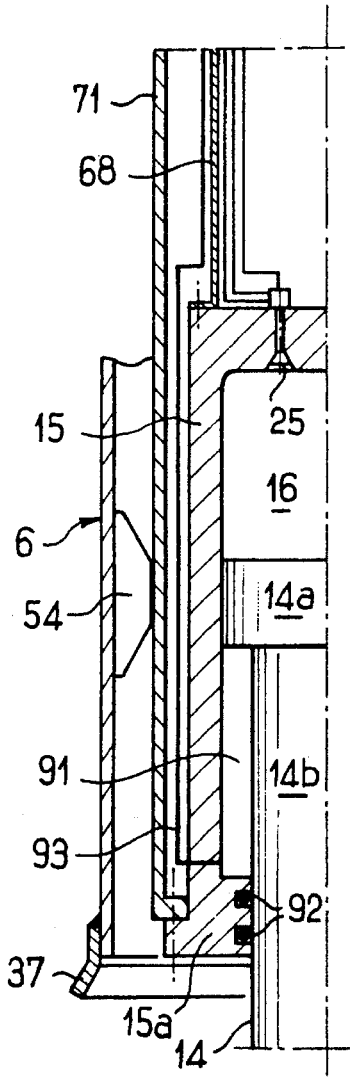
FIG. 24 is a half-view in vertical section showing another embodiment of the assembly comprising a hydraulic cylinder, a plunger piston, and a low pressure accumulator.

FIG. 24 shows another embodiment which is similar to that of FIG. 23 but which differs therefrom by the fact that the auxiliary actuator 31 is omitted. The functions of the actuator 31 may be fulfilled by the hydraulic cylinder and plunger piston assembly 15, 14 itself, which is implemented in a manner that is a little different from that described above. More precisely, the plunger piston 14 is made in the form of a stepped piston so as to create a chamber 91 beneath its larger portion **14*a*, between said portion 14*a* and an end wall 15*a* of the hydraulic cylinder 15 through which the narrower portion 14*b* of the piston 14 passes. In this case, at least one suitable sealing ring 92 must be provided to prevent oil leaking between the end wall 15*a* and the narrower portion 14*b* of the piston 14. A pipe 93 connected to the cylinder 15 and communicating with the chamber 91 enables either to evacuate the oil contained in the chamber 91 to the hydraulic fluid reservoir 26 (FIG. 16) or else to feed oil under pressure to the chamber 91 for the purpose of raising the piston 14 inside the cylinder 15**.

Figure 25:
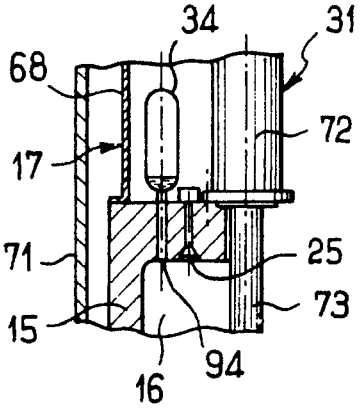
FIG. 25 is a fragmentary view in vertical section showing a high pressure accumulator associated with the assembly of FIG. 23.

In FIG. 25, there can be seen a high pressure accumulator 34 which is disposed inside the low pressure accumulator 17 and which communicates with the chamber 16 of the cylinder 15 via an orifice 94. Although FIG. 25 shows only one accumulator 34, there may be a larger number of them disposed in similar manner to the accumulator shown. The pressure accumulator(s) 34 serve(s) to absorb the pressure surges that may be generated during the process of putting the deck 1 into place, in particular during the above-described third stage.

FIG. 26 is a diagram of the hydraulic circuits of the system of the present invention. This diagram shows all of the elements that have already been described with reference to FIGS. 13 to 15, 23 and 25. It is therefore not deemed necessary to describe these elements again. The controlled non-return valves 24 are shown as being four in number purely by way of indication. The high pressure accumulators 34 are shown as being three in number, again purely by way of indication. The controlled on-off valve 25 is shown in the form of a distributor valve having two ports and two positions, capable of being controlled from both sides by applying control pressure to one or other of the two pipes 83. Clearly the distributor valve 25 could be controlled by pressure from one side only and be returned by a spring on the other side. For example, the distributor valve 25 could be held in its closed position by a spring, and it could be switched to its open position by pressure control.

Compared with existing systems for installing an offshore platform deck by means of a ballastable barge, such as the system described in the publication mentioned in the introduction of the present specification, the system of the invention includes the following advantages, among others:

a) No metal against metal shock takes place between the deck 1 and the support structure 3 during the installation operation. Large dynamic forces and battering of the contact surfaces are thereby avoided.

b) Because the hydraulic cylinder and plunger piston assemblies 15, 14 are locked during the above-described third stage, the shock absorbers are subjected to small forces only.

c) The system is simple and can use components that are already tested in the industry. It is therefore very reliable.

d) The power required to operate the system is very small. The system is therefore cheap.

e) By using a greater or smaller number of hydraulic cylinder and plunger piston assemblies 15, 14, it is possible to install decks of very different weights.

Naturally the embodiments of the invention as described above have been given purely by way of non-limiting example and numerous modifications can easily be provided by the person skilled in the art without thereby going beyond the ambit of the invention. This applies in particular to the centering cones 37 which could be fixed to the receiver portions 7 instead of being fixed to the bottom ends of the legs 6 of the deck 1.

We claim:

1. A method of installing a deck of an offshore platform on a support structure at sea, said deck including a plurality of vertical tubular legs each containing a hydraulic cylinder and plunger piston assembly, said support structure including a number of vertical tubular members and/or of piles corresponding to the number of legs of the deck, each vertical member or pile including at its top end a receiver portion suitable for receiving the bottom end of the plunger piston associated with a leg of the deck, the method comprising the following operations:

a) bringing a barge between the vertical members or piles of the support structure, with the deck supported on the barge by a plurality of retractable supports;

b) positioning and holding the barge in such a manner that the legs of the deck are and remain substantially in alignment with the corresponding vertical members or piles of the support structure;

c) lowering the plunger pistons until their bottom ends come into abutment against the receiver portions of the corresponding members or piles of the support structure;

d) ballasting the barge to lower it and transfer the load of the deck to the support structure;

e) subsequently retracting the supports situated between the deck and the barge so that the deck is supported solely by the support structure;

f) making rigid connections between the legs of the deck and the vertical members or piles of the support structure; and g) evacuating the barge from between said vertical members or piles;

consisting, for operation c), in allowing the plunger pistons to descend under their own weight, while establishing large flow rate bidirectional communication between a low pressure hydraulic fluid accumulator and a chamber in the top portion of each hydraulic cylinder above the plunger pistons so as to bring each of the plunger pistons into contact with the receiver portion of the corresponding vertical member or pile of the support structure;

h) then, during an observation stage, allowing the barge, the deck, and the hydraulic cylinders to oscillate vertically with the swell relative to the plunger pistons bearing against said corresponding receiver portions, while leaving said bidirectional communication open;

i) then establishing high flow rate communication that is unidirectional only from said low pressure accumulator to said chamber in each hydraulic cylinder so as to prevent any downwards movement of the deck and of the hydraulic cylinders, but without preventing any upwards movement thereof and without preventing the chamber filling with hydraulic fluid should there pass beneath the barge a wave having its crest at a level that is higher than the level that the water occupied at the moment when unidirectional communication was established;

j) subsequently performing operations d) and e);

k) subsequently establishing low flow rate communication from said chamber of each hydraulic cylinder to a hydraulic fluid reservoir so as to enable the deck and its legs to be lowered until the legs come into contact with and are supported by the top ends of the vertical members or of the piles of the support structure; and l) subsequently performing operation f).

2. A method according to claim 1, wherein the plunger pistons are braked during their downwards movement.

3. An offshore platform deck including a plurality of vertical tubular legs designed to be vertically assembled on vertical members or piles of a previously-immersed support structure, each leg of the deck containing a hydraulic cylinder and plunger piston assembly in which the cylinder is fixed to the leg and the plunger piston is capable of being displaced vertically relative to the cylinder and to the leg for the purpose of being brought into abutment against a corresponding receiver portion provided at a top end of each vertical member or pile of the support structure, and a control and monitoring unit for controlling the operation of the hydraulic cylinder and plunger piston assemblies contained in the legs of the deck, wherein, inside each hydraulic cylinder, above its plunger piston, a chamber is formed which is filled with hydraulic fluid, and wherein each leg also contains a low pressure hydraulic accumulator, first means capable of being controlled to establish high flow rate bidirectional communication between the low pressure accumulator and said chamber of the hydraulic cylinder, second means capable of being controlled to establish high flow rate unidirectional communication from the low pressure accumulator to said chamber, and third means capable of being controlled to establish low flow rate communication between said chamber and a hydraulic fluid reservoir, said first, second, and third means being controlled in sequence by said control and monitoring unit.

4. An offshore platform deck according to claim 3, wherein at least one controlled non-return valve constitutes both said first and second means for establishing communication.

5. An offshore platform deck according to claim 3, wherein said third means for establishing communication comprise at least one controlled on-off valve or a two-port and two-position controlled distributor valve, and a flow rate reducer connected in series with the on-off valve or the distributor valve.

6. An offshore platform deck according to claim 3, wherein each leg of the deck further contains an auxiliary actuator operating essentially in traction and having a cylinder fixed coaxially to the hydraulic cylinder of the hydraulic cylinder and plunger piston assembly, and a piston rod penetrating in sealed manner into said hydraulic cylinder and being connected to the plunger piston.

7. An offshore platform deck according to claim 3, wherein each hydraulic cylinder and plunger piston assembly is implemented in the form of a double-acting actuator, a second chamber filled with hydraulic fluid being formed in the hydraulic cylinder beneath a larger diameter portion of the plunger piston, said second chamber being selectively connectable to a source of fluid under pressure to raise the plunger piston or to hold it in its high position, and to a hydraulic fluid reservoir to allow the plunger piston to descend.

8. An offshore platform deck according to claim 6, wherein the first, second, and third means for establishing communication are controllable by pressure, and wherein said control and monitoring unit includes a hydraulic power unit designed to deliver the hydraulic pressure required for controlling the first, second, and third means for establishing communication, and the pressure required for powering the auxiliary actuator.

9. An offshore platform deck according to claim 7, wherein the first, second, and third means for establishing communication are controllable by pressure, and wherein said control and monitoring unit includes a hydraulic power unit designed to deliver the hydraulic pressure required for controlling the first, second, and third means for establishing communication, and the pressure required for powering the second chamber of the double-acting actuator forming the hydraulic cylinder and plunger piston assembly.

10. An offshore platform deck according to claim 3, wherein each leg of the deck contains a high pressure accumulator communicating with the chamber of the hydraulic cylinder situated above the plunger piston.

11. An offshore platform deck according to claim 10, wherein the high pressure accumulator is disposed inside the low pressure accumulator.

12. An offshore platform deck according to claim 3, wherein each hydraulic cylinder and plunger piston assembly and the low pressure accumulator associated therewith are made or assembled in the form of a module which is fixed in detachable manner to the inside of the corresponding leg of the deck.

13. An offshore platform deck according to claim 3, wherein the plunger piston is equipped at its bottom end with a swivel-mounted foot constituted by at least one piece having a surface in the form of a spherical cap matching a surface of complementary shape provided at the bottom end of the plunger piston.

14. An offshore platform comprising an offshore platform deck according to claim 3 and a support structure for said offshore platform deck, said support structure comprising a plurality of vertical members or piles designed to be assembled to and to support respective legs of said offshore platform deck, each vertical member or pile including a receiver portion at its top end designed to receive and serve as an abutment for a respective plunger piston mounted to move vertically in a corresponding leg of said offshore platform deck, wherein each said receiver portion is in the form of a cavity which is upwardly open and whose inside diameter is substantially greater than the outside diameter of the associated plunger piston, and wherein the bottom of each said cavity is provided with a respective stratified multi-layer shock absorber assembly composed of a lower layer made of pad forming elastomer material, an intermediate layer made of a metal reinforcing plate and an upper antifriction layer made of a substance that is selected to present a low coefficient of friction with the substance of the associated plunger piston, thereby enabling limited horizontal sliding movements between each plunger piston and the bottom of the associated cavity.

* * * * *